US012398634B2

(12) United States Patent
Anderson

(10) Patent No.: US 12,398,634 B2
(45) Date of Patent: Aug. 26, 2025

(54) PROCESS FOR PROVIDING STEAM FOR A HYDROCARBON RECOVERY PROCESS

(71) Applicant: Cenovus Energy Inc., Calgary (CA)

(72) Inventor: Timothy Bennet Anderson, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 18/658,704

(22) Filed: May 8, 2024

(65) Prior Publication Data

US 2024/0287884 A1 Aug. 29, 2024

Related U.S. Application Data

(62) Division of application No. 17/513,659, filed on Oct. 28, 2021, now Pat. No. 12,281,553.

(60) Provisional application No. 63/124,205, filed on Dec. 11, 2020.

(51) Int. Cl.
*E21B 43/24* (2006.01)

(52) U.S. Cl.
CPC ..... *E21B 43/24* (2013.01)

(58) Field of Classification Search
CPC ..... E21B 43/24; C09K 8/34
USPC ..... 166/303
See application file for complete search history.

(56) References Cited

U.S. PATENT DOCUMENTS 10,634,340 B2 * 4/2020 Agar ..... F22B 1/28
2003/0192693 A1 * 10/2003 Wellington ..... E21B 41/0064 166/267
2004/0020642 A1 * 2/2004 Vinegar ..... E21B 47/0224 166/245
2008/0078552 A1 * 4/2008 Donnelly ..... E21B 43/24 166/57
2022/0186596 A1 6/2022 Anderson

FOREIGN PATENT DOCUMENTS

CA 2745879 A1 6/2010

OTHER PUBLICATIONS

"An Overview of Heavy Oil Properties and its Recovery and Transportation Methods," Santos et al., Brazilian Journal of Chemical Engineering; vol. 31, No. 03, pp. 571-590; 2014.

* cited by examiner

*Primary Examiner* — William D Hutton, Jr.
*Assistant Examiner* — Ashish K Varma
(74) *Attorney, Agent, or Firm* — Gordon & Jacobson, P.C.

(57) ABSTRACT

A process for providing steam from a steam source to a well located remote from the steam source, includes heating a first portion of a first pipe by directing steam along the first portion of the first pipe that extends along a first segment of a path between the steam source and the well, across a first cross-over pipe, and back to the steam source, along a first portion of a second pipe that extends along the first segment of the path. The process also includes heating a second portion of the first pipe by directing steam along the first portion and the second portion of the first pipe, across a second cross-over pipe, and back to the steam source along a second portion of the second pipe. The first pipe and the second pipe are utilized to transport steam to the well.

8 Claims, 10 Drawing Sheets

PROCESS FOR PROVIDING STEAM FOR A HYDROCARBON RECOVERY PROCESS

CROSS-REFERENCE TO RELATED APPLICATIONS

This application is a divisional of U.S. application Ser. No. 17/513,659, filed on Oct. 28, 2021, which claims benefit of U.S. Provisional Patent Application No. 63/124,205 filed on Dec. 11, 2020, the contents of which are hereby incorporated herein by reference in their entireties.

TECHNICAL FIELD

The present invention relates to providing steam from a source to a well for use in a hydrocarbon recovery process.

BACKGROUND

Extensive deposits of hydrocarbons exist around the world. Reservoirs of such deposits may be referred to as reservoirs of light oil, medium oil, heavy oil, extra-heavy oil, bitumen, or oil sands, and include large oil deposits in Alberta, Canada. It is common practice to segregate petroleum substances into categories that may be based on oil characteristics, for example, viscosity, density, American Petroleum Institute gravity (° API), or a combination thereof. For example, light oil may be defined as having an ° API≥31, medium oil as having an ° API≥22 and <31, heavy oil as having an ° API≥10 and <22 and extra-heavy oil as having an ° API≤10 (see Santos, R. G., et al. *Braz. J. Chem. Eng.* Vol. 31, No. 03, pp. 571-590). Although these terms are in common use, references to different types of oil represent categories of convenience, and there is a continuum of properties between light oil, medium oil, heavy oil, extra-heavy oil, and bitumen. Accordingly, references to such types of oil herein include the continuum of such substances, and do not imply the existence of some fixed and universally recognized boundary between the substances.

One thermal method of recovering viscous hydrocarbons in the form of bitumen, also referred to as oil sands, is known as steam-assisted gravity drainage (SAGD). In the SAGD process, pressurized steam is delivered through an upper, horizontal, injection well, also referred to as an injector, into a viscous hydrocarbon reservoir while hydrocarbons are produced from a lower, generally parallel, horizontal, production well, also referred to as a producer, that is near the injection well and is vertically spaced from the injection well. The injection and production wells are generally situated in the lower portion of the reservoir, with the producer located close to the base of the hydrocarbon reservoir to collect the hydrocarbons that flow toward the base of the reservoir.

The injected steam during SAGD initially mobilizes the hydrocarbons to create a steam chamber in the reservoir around and above the horizontal injection well. The term steam chamber in the context of a SAGD operation is utilized to refer to the volume of the reservoir that is heated to the steam saturation temperature with injected steam, and from which mobilized oil has at least partially drained and been replaced with steam vapor. As the steam chamber expands, viscous hydrocarbons in the reservoir and water originally present in the reservoir are heated and mobilized and move with aqueous condensate, under the effect of gravity, toward the bottom of the steam chamber. The hydrocarbons, the water originally present, and the aqueous condensate are typically referred to collectively as emulsion.

The emulsion accumulates and is collected and produced from the production well. The produced emulsion is separated into dry oil for sales and produced water.

The steam that is utilized is produced in a steam generation facility including a steam generator, such as a once through steam generator (OTSG). The cost of the steam generation facility and associated emissions control is significant and affects the economic potential of hydrocarbon recovery.

Improvements in providing steam for hydrocarbon recovery are desirable.

SUMMARY

According to an aspect of an embodiment, there is provided a process for providing steam from a steam source to a well located remote from the steam source, includes heating a first portion of a first pipe by directing steam along the first portion of the first pipe that extends along a first segment of a path between the steam source and the well, across a first cross-over pipe, and back to the steam source, along a first portion of a second pipe that extends along the first segment of the path. The process also includes heating a second portion of the first pipe by directing steam along the first portion and the second portion of the first pipe, across a second cross-over pipe, and back to the steam source along a second portion of the second pipe. The first pipe and the second pipe are utilized to transport steam to the well.

According to another aspect, a process for providing steam from a steam source to a well of a hydrocarbon-bearing formation is provided. The process includes heating a first pipe including a plurality of portions of the first pipe with each of the plurality of portions of the first pipe extending along a respective segment of a path between the steam source and the well. The process also includes heating a second pipe including a plurality of portions of the second pipe with each of the plurality of portions of the second pipe extending along the respective segment of the path between the steam source and the well. Heating the first pipe and the second pipe is carried out by directing steam along a first portion of the first pipe and back along a first portion of the second pipe to heat the first portion of the first pipe and the first portion of the second pipe. After heating the first portion of the first pipe and the first portion of the second pipe, steam is directed along the first portion of the first pipe and a second portion of the first pipe, and back along a second portion of the second pipe and the first portion of the second pipe to heat the second portion of the first pipe and the second portion of the second pipe. The process includes continuing to direct steam along each successive portion of the first pipe and each successive portion of the second pipe after heating each previous portion of the first pipe and each previous portion of the second pipe. After heating each of the plurality of portions of the first pipe and the plurality of portions of the second pipe, utilizing the first pipe and the second pipe to transport steam to the well.

According to another aspect, there is provided a system for providing steam to a well of a hydrocarbon-bearing formation. The system includes a steam source, a first pipe including a plurality of portions of the first pipe with each of the plurality of portions of the first pipe extending along a respective segment of a path between the steam source and the well, a second pipe including a plurality of portions of the second pipe with each of the plurality of portions of the second pipe extending along the respective segment of the path between the steam source and the well, and a plurality of cross-over pipes, each of the cross-over pipes coupling a respective one of the portions of the first pipe with a corresponding one of the portions of the second pipe. Valve arrangements are associated with the cross-over pipes. The valve arrangements are operable to direct fluid flow from one of the portions of the first pipe to a corresponding one of the portions of the second pipe, when in a preheating configuration, and direct fluid flow from the one of the portions of the first pipe to a subsequent one of the portions of the first pipe as well as direct fluid flow from the corresponding one of the portions of the second pipe to a subsequent one of the portions of the second pipe, when in a steam delivery configuration.

BRIEF DESCRIPTION OF THE DRAWINGS

Embodiments of the present invention will be described, by way of example, with reference to the drawings and to the following description, in which.

DETAILED DESCRIPTION

Figure 1:
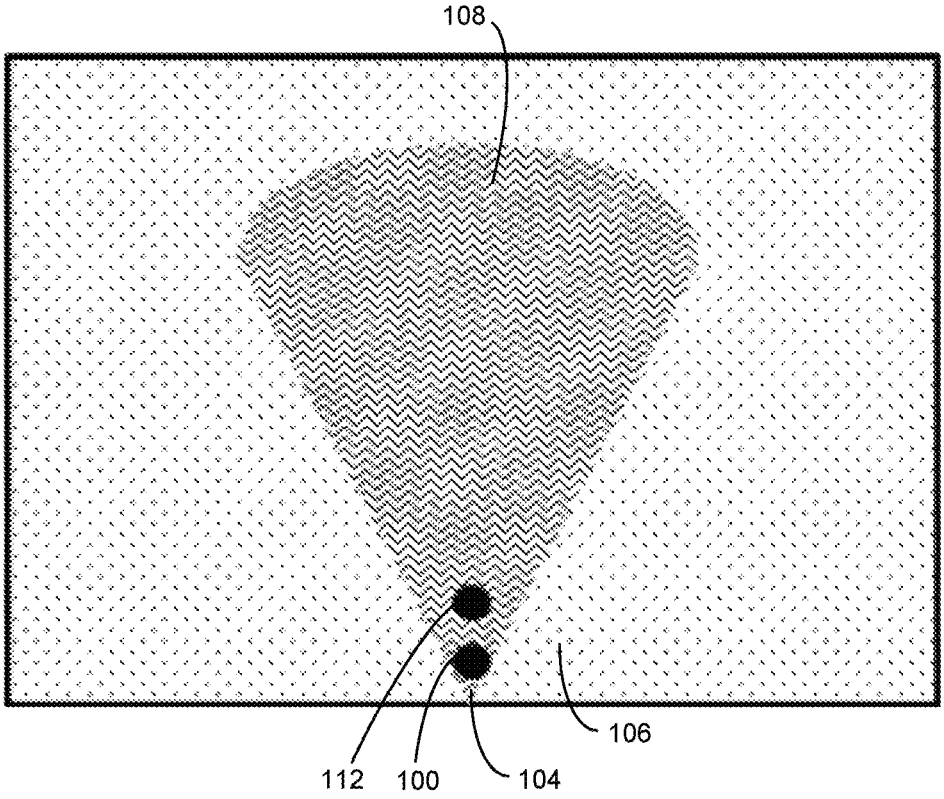
FIG. 1 is a sectional view through a reservoir, illustrating a SAGD well pair.

The disclosure generally relates to a process for providing steam from a steam source to a well that is at a location remote from the steam source. The cost of the steam generation facilities and associated emissions control is significant and reduces the economic potential of hydrocarbon recovery. The use of steam generation facilities a significant distance away, such as several kilometers away, facilitates the use of steam generation facilities for more than one reservoir and improves economic viability of hydrocarbon recovery. The process includes heating a first portion of a first pipe by directing steam along the first portion of the first pipe that extends along a first segment of a path between the steam source and the well, across a first cross-over pipe, and back to the steam source, along a first portion of a second pipe that extends along the first segment of the path. The process also includes heating a second portion of the first pipe by directing steam along the first portion and the second portion of the first pipe, across a second cross-over pipe, and back to the steam source along a second portion of the second pipe. The first pipe and the second pipe are utilized to transport steam to the well.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Reference is made herein to an injection well and a production well. The injection well and the production well may be physically separate wells. Alternatively, the production well and the injection well may be housed, at least partially, in a single physical wellbore, for example, a multilateral well. The production well and the injection well may be functionally independent components that are hydraulically isolated from each other, and housed within a single physical wellbore.

The use of steam is described below with reference to a steam-assisted gravity drainage (SAGD) hydrocarbon recovery process. The steam may be utilized in other hydrocarbon recovery processes and the embodiments described herein may be equally applicable to those hydrocarbon recovery processes, such as, for example, a solvent-assisted process or a cyclic steam stimulation process.

Figure 2:
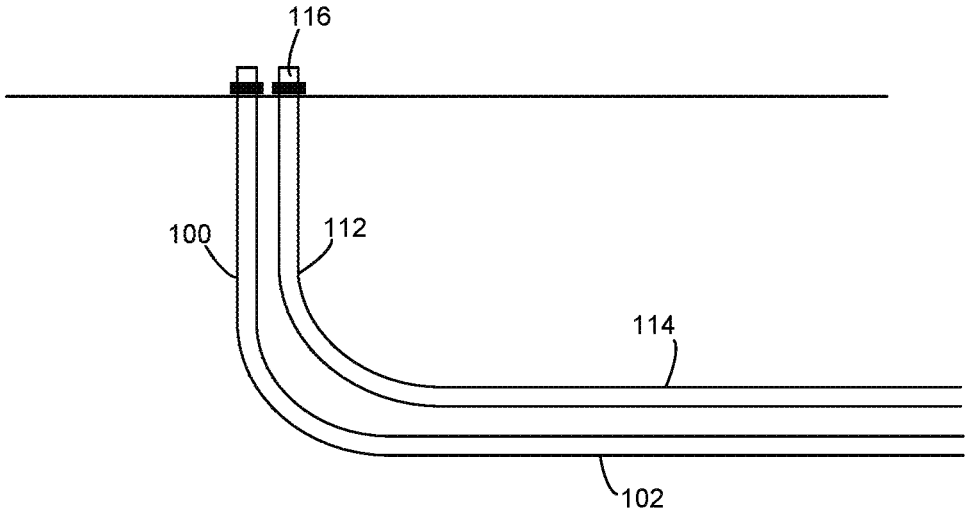
FIG. 2 is a sectional side view illustrating a SAGD well pair including an injection well and a production well.

As described above, a steam-assisted gravity drainage (SAGD) process may be utilized for mobilizing viscous hydrocarbons. In the SAGD process, a well pair, including a hydrocarbon production well and a steam injection well are utilized. An example of a well pair is illustrated in FIG. 1 and FIG. 2. The hydrocarbon production well 100 includes a generally horizontal portion 102 that extends near the base or bottom 104 of the hydrocarbon reservoir 106. An injection well 112 also includes a generally horizontal portion 114 that is disposed generally parallel to and is spaced vertically above the horizontal portion 102 of the hydrocarbon production well 100.

During production utilizing SAGD, steam is injected into the injection well head 116 and through the steam injection well 112 to mobilize the hydrocarbons and create a steam chamber 108 in the reservoir 106, around and above the generally horizontal portion 114.

Viscous hydrocarbons in the reservoir 106 are heated and mobilized and the mobilized hydrocarbons drain under the effects of gravity. Fluids, including the mobilized hydrocarbons along with condensate are collected in the generally horizontal portion 102 and are recovered via the hydrocarbon production well 100. Production may be carried out for any suitable period of time.

The steam that is injected via the injection well 112 may be generated at least partially from the produced water, for example, recovered from the production well 100. The produced water is de-oiled and softened to provide at least a portion of feed water to the steam generation facilities. The feed water may include water produced from the hydrocarbon recovery process or, for example, another hydrocarbon recovery process occurring in another reservoir, fresh water, water not previously utilized in the hydrocarbon recovery process, or a combination thereof.

The steam is generated utilizing steam generation facilities. The steam generation facilities are generally constructed near a particular reservoir for use in hydrocarbon recovery for that reservoir. Thus, the steam generation facilitates are typically located relatively close to the steam injection well.

The steam that is utilized is produced in a steam generation facility, which includes a steam generator, such as a once through steam generator (OTSG). The cost of the steam generation facilities and associated emissions control is significant and reduces the economic potential of hydrocarbon recovery. The use of steam generation facilities a significant distance away, such as several kilometers away, facilitates the use of steam generation facilities for more than one reservoir and improves economic viability of hydrocarbon recovery.

Steam may travel a greater distance from the steam generation facility as a new steam line to a new steam injection well may be coupled to the steam piping delivering steam to a well pad or pads already in operation. In such a case, the steam piping delivering the steam to a well pad or pads already in operation is utilized as the steam source. Thus, the steam piping delivering steam to the well pad already in operation is already heated with steam already travelling through the steam piping. The new steam line may therefore extend a shorter distance from the steam piping that is delivering steam to the well pad already in operation, to the new steam injection well. Delivery of steam to new steam injection wells located farther away from any steam source, which may be the steam generation facility or steam lines already utilized in the delivery of steam to injection wells, is still problematic.

Steam quality degrades over long distances, such as distances located more than 5 km away. Heat loss that occurs, particularly at lower flow rates such as those during a start-up stage, results in reduced steam quality. In particular, with little pressure loss in a steam pipe, as is experienced at low flow rate, heat loss is primarily responsible for the formation of condensate along the steam pipe. At higher flow rates, a pressure drop occurs as steam travels through the piping. Steam travelling through cold piping produces excess condensate that lowers the quality of steam delivered to the injection well and may result in pooling at low points along the piping. Drains may be utilized to drain off the pooled water and the pooled water may be trucked back to the steam facilities at great expense. Even with drains to drain the condensate, however, pooling may still result in significant problems such as a water hammer, causing significant damage to the pipeline, and potentially dangerous conditions for workers. A water hammer event, for example, may lead to loss of equipment and shutdown of the pipeline for extended periods of time during which steam is not delivered to the injection well. Any operation therefore ceases or is delayed, resulting in significant expense and therefore increased cost of recovery of hydrocarbons.

Ambient temperatures outside a steam pipe are significantly lower than inside the steam pipe when the steam pipe is utilized to direct steam to the injection well and into the reservoir. The ambient temperature outside the steam pipe may be, for example, −40° C. or even lower. The steam pipe is therefore insulated to reduce heat loss while directing steam to the injection well. Because of the length of the steam pipe to direct steam to the injection well, the heat loss results in excess condensate in the steam pipe, which is costly to deal with and reduces the quality of the steam injected into the reservoir via the injection well.

With the associated costs to drain and return condensate to the steam facilities and the potential for a catastrophic event, which introduces dangers, added cost to remedy, as well as down time, the length of steam pipelines to deliver steam to a new injection well, is limited, as indicated above.

Figure 3:
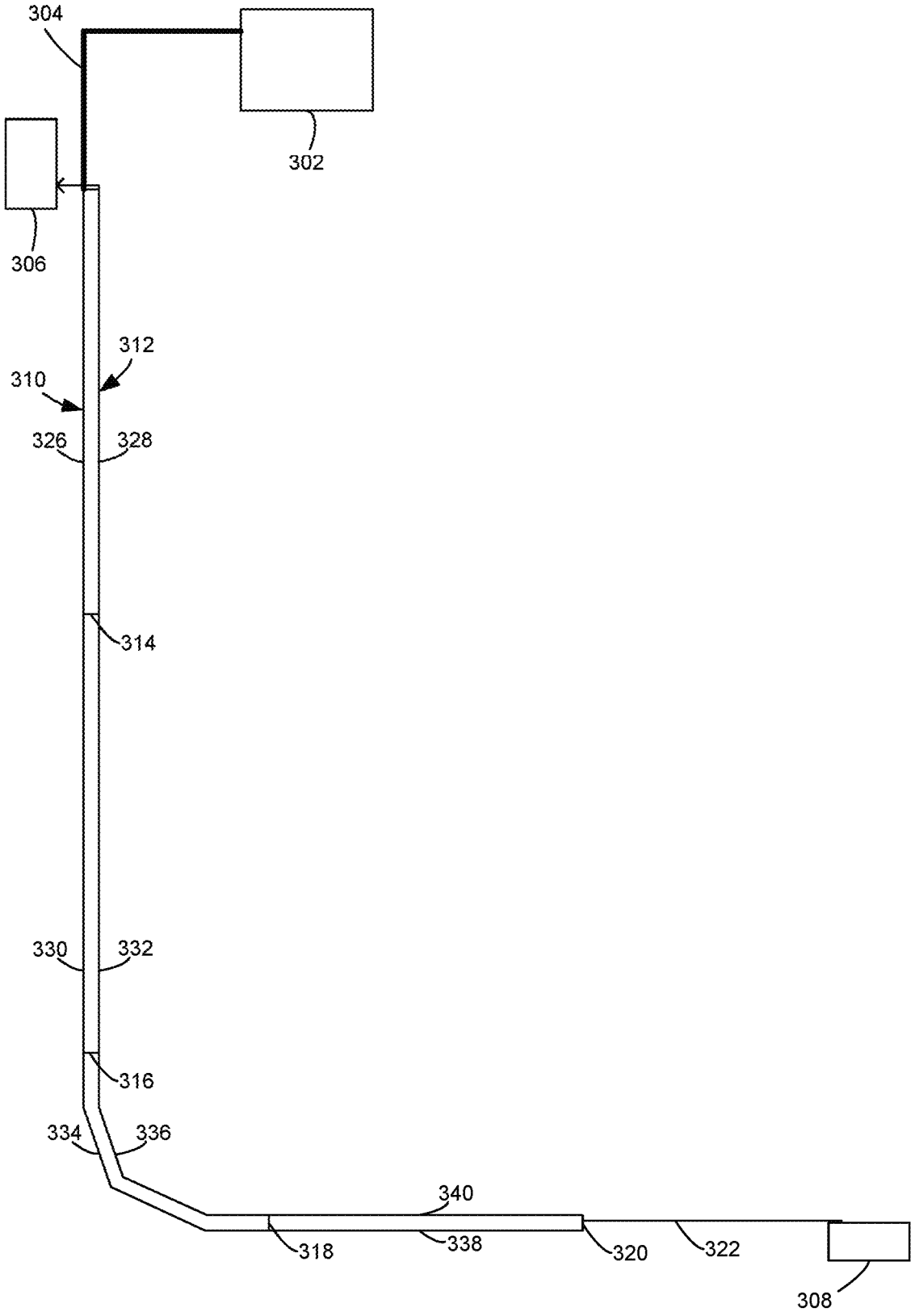
FIG. 3 is a simplified schematic view illustrating a system for use in providing steam in a hydrocarbon recovery operation.

A simplified schematic view illustrating a system for providing the steam to a well of a hydrocarbon-bearing formation, such as that shown and described with reference to FIG. 1 and FIG. 2, is shown in FIG. 3. For the purpose of this explanation, steam generation facilities 302 are utilized for producing hydrocarbons by injecting steam into a plurality of injection wells associated with a reservoir. In the example illustrated in FIG. 3, a well pad 306, which includes a steam injection well is coupled by the steam line 304 to the steam generation facilities 302. Other well pads and steam injection wells may also be coupled to the steam generation facilities 302, either in parallel or in serial connection to provide steam to the well pads.

A well pad 308 that is located several kilometers from the steam generation facilities 302 and from the well pad 306 may also be utilized to produce hydrocarbons. Rather than constructing and operating a new steam generation facility that is located closer to the well pad 308, it is desirable to utilize steam produced from the existing steam generation facility to produce hydrocarbons from the wells at the well pad 308.

The well pad 306 in this example is closer to the well pad 308 than any other operational well pad or the steam generation facilities 302. Steam is already provided from the steam generation facility 302 to the well pad 306 and injected, via the injection well associated with the well pad 306 in a hydrocarbon recovery process. Steam injection and production at the well pad 306 may already be entering a phase in which steam injection slows down or is discontinued, for example.

In this example, the steam line 304 to the well pad 306 is utilized as the steam source for the well pad 308. The steam line 304 providing steam to the well pad 306 may be any suitable steam pipe. For example, the steam line 304 may be a 36 inch steam (914.4 mm) pipe.

Steam piping from the steam source, which in this example is the well pad 306, is utilized to provide steam to the well pad 308. The steam piping includes a first pipe 310 that extends along a path between the well pad 306 and the well pad 308. The path may be greater than 5 km, and may be greater than 10 km. The steam piping also includes a second pipe 312 that extends along the path. The first pipe 310 and the second pipe 312 may extend generally parallel to each other. The first pipe 310 is coupled to the second pipe 312 by cross-over pipes 314, 316, 318, located at intervals along the path between the well pad 306 and the well pad 308. The intervals may be generally regular intervals or may be irregular. In this example, four cross-over pipes 314, 316, 318, 320 are illustrated. Any suitable number of cross-over pipes may be successfully implemented, however, and more crossover pipes may be utilized for longer paths. The cross-over pipes 314, 316, 318 generally divide the first pipe 310 into portions and divide the second pipe 312 into portions referred to below.

The first pipe 310 and the second pipe 312 may be any suitable size for providing steam to the well pad 308. For example, the steam piping from the steam source may be 36 inch (914.4 mm) pipe as indicated above. The first pipe 310 may be 30 inch (762 mm) diameter piping and the second pipe 312 may be 24 inch (609.6 mm) diameter piping. The first pipe 310 and the second pipe 312 are suitable sizes to receive the steam from the piping from the steam source and for providing steam to the well pad 308 at a suitable pressure.

Figure 4:
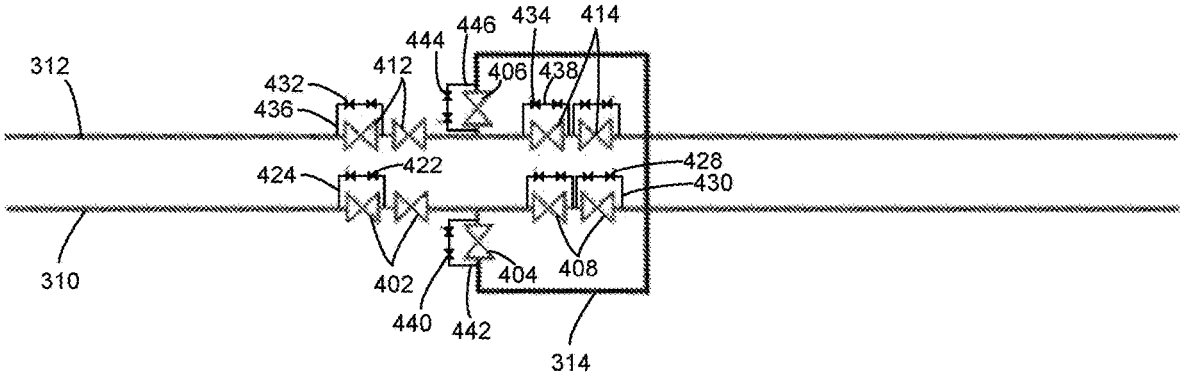
FIG. 4 is a schematic view illustrating a portion of the system of FIG. 3.

Reference is made to FIG. 4, which shows a simplified schematic view of a portion of the system of FIG. 3, including the cross-over pipe 314. The cross-over pipe 314 couples the first pipe 310 to the second pipe 312. A valve arrangement is utilized to control the flow of steam through the first pipe 310, the cross-over pipe 314, and the second pipe 312. The valve arrangement includes a pair of first pipe valves 402 that are located along and control the flow of fluid along the first pipe 310. The pair of first pipe valves 402 may be maintained in the open position to facilitate the flow of steam along the first pipe 310, toward the cross-over pipe 314. These first pipe valves 402 may be utilized for maintenance purposes during operation.

A first cross-over valve 404 is located along the cross-over pipe 314, near the location at which the first pipe 310 joins with the cross-over pipe 314. A second cross-over valve 406 is located along the cross-over pipe 314, near the location at which the cross-over pipe 314 joins the second pipe 312. Further first pipe valves 408 are located along and control the flow of steam along the first pipe 310, on the opposite side of the cross-over pipe 314 as the pair of first pipe valves 402.

The second pipe 312 also includes a pair of second pipe valves 412 that are located along and control the flow of fluid along the second pipe 312. Further second pipe valves 414 are located along and control the flow of steam along the second pipe 312, on the opposite side of the cross-over pipe 314 as the pair of second pipe valves 412. The second pipe valves 412, similar to the first pipe valves 402, may be generally maintained in an open position and utilized for maintenance purposes during operation.

The valve arrangement is operable, by opening or closing or both opening and closing different ones of the pair of first pipe valves 402, the first cross-over pipe valve 404, the second cross-over pipe valve 406, the further first pipe valves 408, the pair of second pipe valves 412, and the further second pipe valves 414, as appropriate to direct steam through the first pipe 310, into the cross-over pipe 314, and into the second pipe 312, or along the first pipe 310 and past the cross-over pipe 314 to continue through the first pipe 310.

In the Example of FIG. 3, the first pipe 310 and the second pipe 312 do not extend the entire distance to the well pad 308. Instead, the first pipe 310 and the second pipe 312 terminate at and are fluidly coupled to an end of a third pipe 322 that extends along a final segment of the path to the well pad 308. A final cross-over pipe 320 and associated valve arrangement is utilized to control the flow of steam from the first pipe 310 into the third pipe 322, or from the first pipe 310 into the second pipe 312. The associated valve arrangement is also utilized to control the flow of steam from the second pipe 312 into the third pipe 322, which is coupled at an opposing end thereof, to the injection well on the well pad 308.

In addition to the first pipe valves 402, the second pipe valves 412, the further first pipe valves 408, and the further second pipe valves 414, bypass pipes and associated bypass pipe valves are included. The bypass pipe valves in the present example include first bypass pipe valves 422 on a first bypass pipe 424, further first bypass pipe valves 428 on a pair of further first bypass pipes 430, second bypass pipe valves 432 on a second bypass pipe 436, and further second bypass pipe valves 434 on a pair of further bypass pipes 438. As shown, the first bypass pipe 424 bypasses one of the first pipe valves 402. The pair of further first bypass pipes 430 each bypass a respective one of the further first pipe valves 408. The second bypass pipe 436 bypasses one of the second pipe valves 412. The further second bypass pipes 438 each bypass a respective one of the further second pipe valve 414.

Each of the first bypass pipe 424, the further first bypass pipes 430, the second bypass pipe 436, and the further second bypass pipes 438 are smaller than the first pipe 310 and 312. For example, each bypass pipe may be a 4 inch (101.6 mm) or a 6 inch (152.4 mm) pipe. In the present example, each bypass pipe includes both a bypass globe valve and a bypass gate valve. Thus, the first bypass pipe valves 422 include a first bypass globe valve and a first bypass gate valve. Similarly, the further first bypass pipe valves 428 include a further first bypass globe valve and a further first bypass gate valve on each of the further first bypass pipes 430. The second bypass pipe valves 432 include a second bypass globe valve and a second bypass gate valve. Similarly, the further second bypass pipe valves 434 include a further second bypass globe valve and a further second bypass gate valve on each of the further second bypass pipes 438.

A bypass pipe and bypass valves may also be associated with each of the first cross-over pipe valve 404 and the second cross-over pipe valve 406. First cross-over bypass valves 440 may be disposed along a first cross-over bypass pipe 442 that bypasses the first cross-over pipe valve 404. The first cross-over bypass pipe valves 440 may include both a bypass globe valve and a bypass gate valve. Second cross-over bypass valves 444 are disposed along a second cross-over bypass pipe 446 that bypasses the second cross-over pipe valve 404. The second cross-over bypass pipe valves 444 include both a bypass globe valve and a bypass gate valve. Each of the first cross-over bypass pipe 442 and the second cross-over bypass pipe are smaller than the first pipe 310 and 312. For example, each bypass pipe may be a 4 inch (101.6 mm) or a 6 inch (152.4 mm) pipe.

Figure 5:
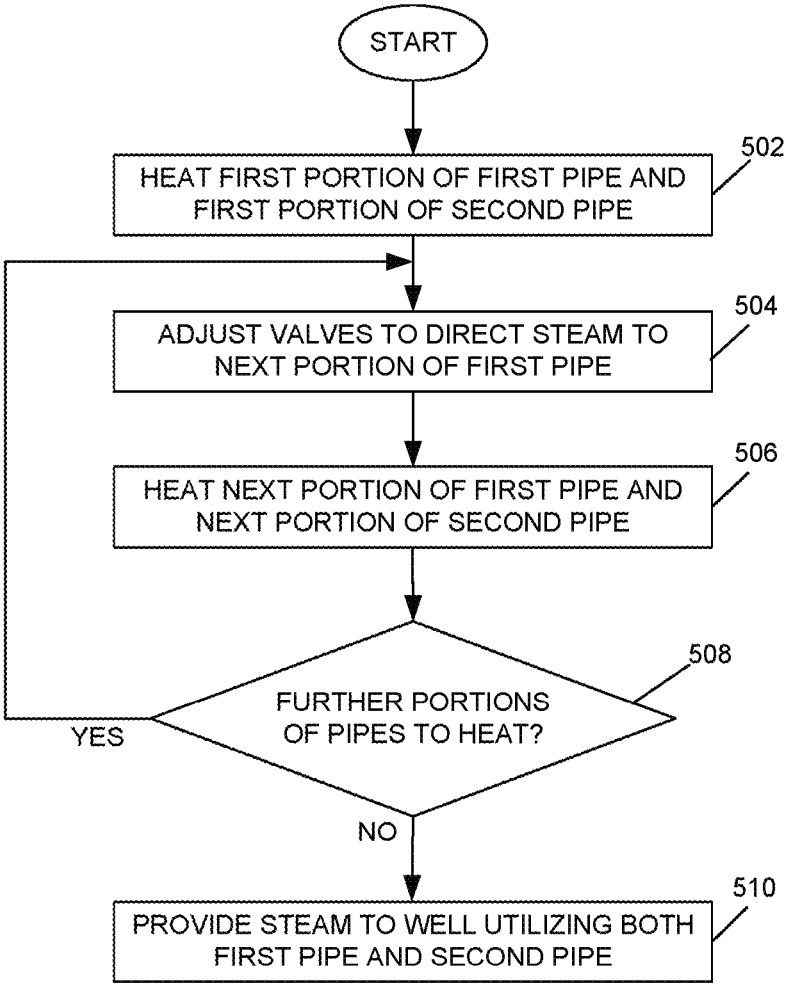
FIG. 5 is a flowchart illustrating a process for providing steam from a steam source to a well of a hydrocarbon-bearing formation.

A flowchart illustrating a process for providing steam from a steam source to a well of a hydrocarbon-bearing formation is illustrated in FIG. 5. The process may include additional or fewer elements than shown and described.

Prior to providing steam to a well pad that is at a location remote from a steam source, such as the well pad 308, the first pipe 310 and the second pipe 312 are heated to reduce the volume of condensate created during steam transportation along the first pipe 310 and the second pipe 312. Without preheating, the heat loss along the pipe causes an excess volume of condensate to form. To reduce condensate formation, the first pipe 310 and the second pipe 312 are heated by heating only a portion of each pipe at a time.

Valves in valve arrangements are configured to direct steam from the steam line at, for example, the well pad 306, along a first portion of the first pipe 310, through a cross-over pipe, and back along the second pipe 312 to the well pad 306. Thus, the steam is diverted along the first pipe 310 and back through the second pipe 312 to the well pad 306. The steam that travels to the well pad 306, travels a greater distance as the steam is sent along the first pipe 310 and the second pipe 312.

The valves directing the flow of steam from the first pipe 310, through the cross-over pipe 314 and back along the second pipe 312 are open and the valves controlling flow of the steam into a second portion of the first pipe 310 and into a second portion of the second pipe 312 are closed.

Steam is directed along the first portion of the first pipe 310, through the cross-over pipe 314, and through the first portion of the second pipe 312 to heat the first portion of the first pipe and the first portion of the second pipe at 502. The steam may be directed along the first portion of the first pipe 310, through the cross-over pipe 314, and through the first portion of the second pipe 312 for a predetermined period of time for preheating, or based on a measurement, such as a steam temperature measurement and, optionally, steam pressure. For example, steam may be slowly introduced into the first portion of the first pipe 310 at low flow rate and back along the first portion of the second pipe 312 until the steam reaches an initial target temperature and pressure. Steam may be directed to heat the first portion of the first pipe 310 and the first portion of the second pipe 312 until the steam reaches a target temperature and pressure. Thus, the temperature and pressure is monitored and, in response to determining that the steam reaches the target temperature and pressure, the process continues at 504. The temperature and pressure builds in the first portion of the first pipe 310 and in the first portion of the second pipe 312. The temperature may be monitored by instrumentation or temperature guns, for example.

Visual indicators of steam quality may also be utilized to determine if condensate pooling is occurring at low points along each of the first pipe 310 and the second pipe 312. During heating, condensate is drained from drains at low points along the first pipe 310 and at low points along the second pipe 312. When very little condensate drains from the low points and primarily steam vapor exits the drain instead of liquid condensate, the steam quality is high. When the temperature reaches a target or is within a target temperature range, and condensate no longer drains out of the drains, the process continues at 504.

The valve arrangements are adjusted at 504 by switching valves to direct steam from the first portion of the first pipe 310 and into the second portion of the first pipe 310. One example of adjustment of the valve arrangements is described in more detail below.

To begin heating the second portion of the first pipe 310 and the second portion of the second pipe 312, a first one of the further first pipe valves 408 is opened while the second one of the further first pipe valves 408 is closed. The gate valve of the further first bypass pipe valves 428 along the further first bypass pipe 430 that bypasses the second one of the further first pipe valves 408 is opened while the globe valve of the further first bypass pipe valves 428 along the further first bypass pipe 438 that bypasses the second one of the further first pipe valves 408 remains closed.

The globe valve of the further first bypass pipe valves 428 along the further first bypass pipe 430 that bypasses the second one of the further first pipe valves 408 is slowly opened allowing steam to enter the second portion of the first pipe 310, across the second cross-over pipe, and into the second portion of the second pipe 312. A second one of the further second pipe valves 414 may be opened while a first one of the further second pipe valves 414 remains closed. The pressure and temperature begin to rise in the second portion of the first pipe 310 and the second portion of the second pipe 312.

When the temperature and pressure in the second portion of the second pipe 312 reach a target temperature and pressure, the second cross-over pipe valve 406 is closed, while the second cross-over bypass pipe valves 444 both remain open. As indicated above, the further second bypass pipe valves 434 along the further second bypass pipe 438 that bypasses the second one of the further second pipe valves 414 includes a gate valve and a globe valve. The gate valve along the further second bypass pipe 438 that bypasses the first one of the further second pipe valves 414 is opened while the globe valve along the further second bypass pipe 438 that bypasses the first one of the further second pipe valves 414 remains closed.

The globe valve of the second cross-over bypass pipe valves 444 is then slowly closed to reduce the flow rate across the cross-over pipe 314, reducing the pressure in the first portion of the second pipe 312, adjacent the first one of the further second pipe valves 414. When the pressure on each side of the first one of the further second pipe valves 414 is close to equivalent or within an acceptable range of each other, the globe valve along the further second bypass pipe 438 that bypasses the first one of the further second pipe valves 414 is slowly opened, facilitating the flow of steam through the further second bypass pipe 438 that bypasses the first one of the further second pipe valves 414. The globe valve of the second cross-over bypass pipe valves 444 is closed completely as the globe valve along the further second bypass pipe 438 that bypasses the first one of the further second pipe valves 414 is slowly opened.

Condensate that forms in the first pipe 310 or in the second pipe 312 is drained off utilizing drains. Thus, as the second portion of the first pipe 310 and the second portion of the second pipe 312 begin warming up with the low flow rate of steam passing through, condensate is drained off and, for example, stored in tanks for trucking back for recycling.

The second one of the further first pipe valves 408 is opened facilitating the flow of steam through the second one of the further first pipe valves 408. The first one of the further second pipe valves 414 is then opened, facilitating increased flow of steam through the second portion of the first pipe 310 and the second portion of the second pipe 312.

The valves in the valve arrangement associated with a second cross-over pipe are configured to direct steam from the second portion of the first pipe, through the second cross-over pipe, and back along the second portion of the second pipe. Thus the valves directing the flow of steam from the first pipe 310, through the second cross-over pipe, and back along the second pipe 312 are open and the valves controlling flow of the steam into the next portion of the first pipe and into the next portion of the second pipe are closed.

Steam is directed along the first portion of the first pipe 310, along the second portion of the first pipe 310, through the second cross-over pipe, through the second portion of the second pipe 312, and through the first portion of the second pipe 312 to continue to heat the second portion of the first pipe and the second portion of the second pipe. The steam may be directed to heat the second portion of the first pipe 310 and the second portion of the second pipe 312 for a predetermined period of time, or based on a measurement, such as a steam temperature measurement and, optionally, steam pressure.

Visual indicators of steam quality may also be utilized to determine if condensate pooling is occurring at low points along each of the first pipe 310 and the second pipe 312. Condensate is drained from drains at low points along the first pipe 310 and at low points along the second pipe 312. When very little condensate drains from the low points and primarily steam vapor exits the drain instead of liquid condensate, the steam quality is high. When the temperature reaches a target or is within a target temperature range and condensate no longer drains out of the drains, the process continues at 508.

After the second portion of the first pipe 310 and the second portion of the second pipe 312 are heated at 506, the process continues to 508.

The process is repeated for each portion of the first pipe and each portion of the second pipe until all of the portions of the first pipe and the second pipe are heated. After heating all of the portions of the first pipe and the second pipe, as determined at 508, the process continues at 510.

Steam is provided to the injection well on the well pad at 510 by directing steam from the first pipe 310 to the injection well. Thus, the valve arrangement associated with the final cross-over pipe is adjusted by switching to facilitate steam flow from the end of the first pipe and into a third pipe 322 coupled to the injection well. During a start-up phase, during which a low volume of steam is injected by the injection well on the well pad, steam at a high flow rate may be directed along the first pipe 310 and back along the second pipe 312 while the low volume of steam for start-up is directed along the third pipe.

After start-up and during the production phase, a higher volume of steam is utilized to facilitate production of hydrocarbons. Steam may then be directed along the first pipe 310 and into the third pipe 322, and steam may also be directed along the second pipe 312 and into the third pipe 322 to provide steam to the injection well.

Reference is again made to the Example of FIG. 3, FIG. 4, and FIG. 6 through 10 to describe an example of the method of FIG. 5. As indicated, prior to providing steam to the well pad 308, the first pipe 310 and the second pipe 312 are heated to reduce the volume of condensate created during steam transportation along the first pipe 310 and the second pipe 312.

The valves in the valve arrangements are configured to direct steam from the steam line 304 at the well pad 308, along a first portion 326 of the first pipe 310, through the first cross-over pipe 314, and back along the first portion 328 of the second pipe 312 to the well pad 306. Steam may initially be directed at a low flow rate along the first portion 326 of the first pipe 310, through the first cross-over pipe 314, and back along the first portion 328 of the second pipe 312.

The pair of first pipe valves 402, the first cross-over valve 404, the second cross-over valve 406, and the pair of second pipe valves 412 are eventually all open to direct the flow of steam from the first portion 326 of the first pipe 310, through the cross-over pipe 314 and back along the first portion 328 of the second pipe 312 to the well pad 306 at higher flow rate. The further first pipe valves 408 and the further second pipe valves 414 are closed to inhibit flow of steam into a second portion 330 of the first pipe 310 and the second portion of the second pipe 332.

Figure 6:
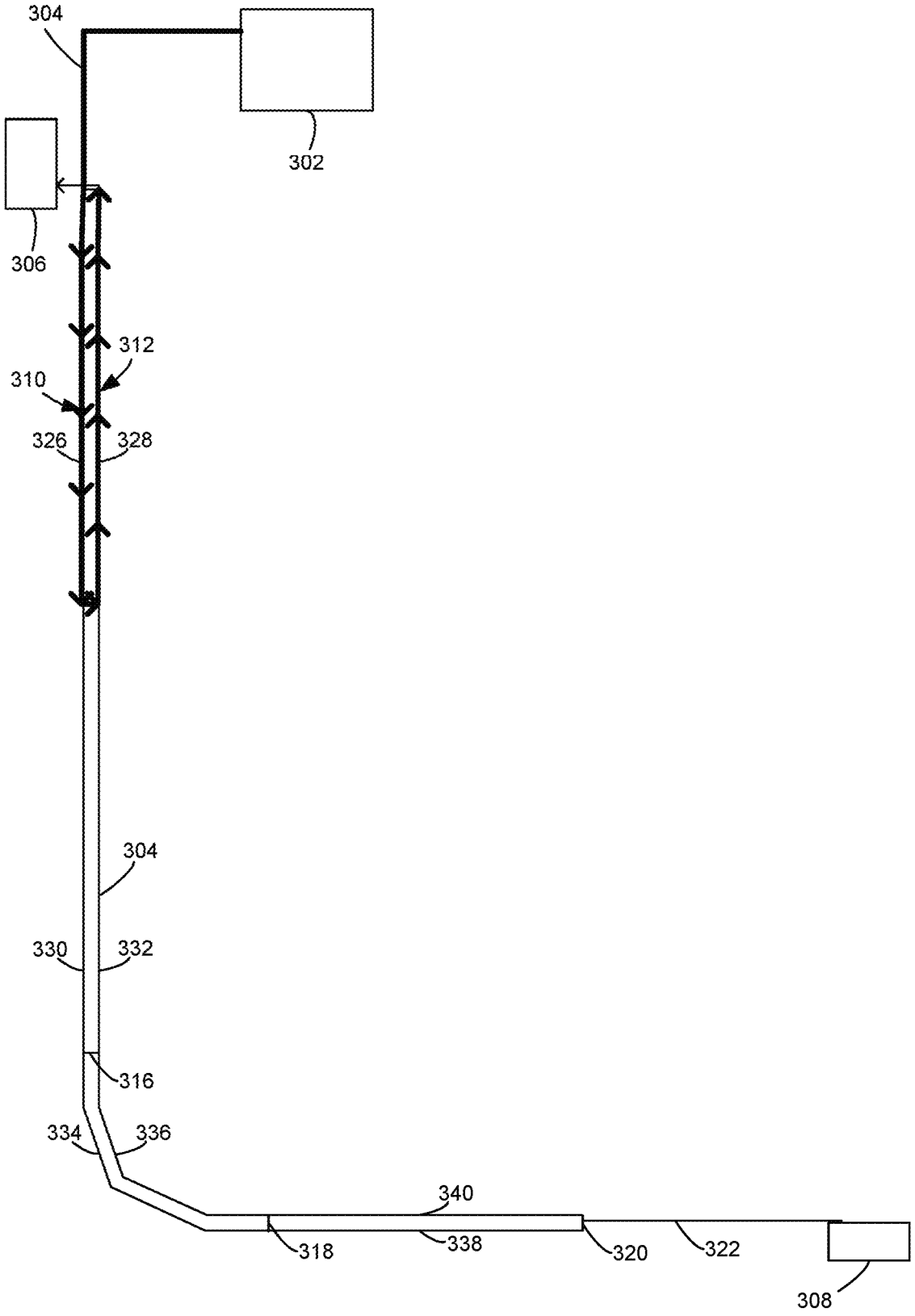
FIG. 6 through FIG. 10 illustrate the system of FIG. 3 utilized in the method of FIG. 5.

As shown by the arrows in FIG. 6, steam is directed along the first portion 326 of the first pipe 310, through the cross-over pipe 314, and through the first portion 328 of the second pipe 312 to heat the first portion 326 of the first pipe 310 and the first portion 328 of the second pipe 312 at 502. The total distance that the steam travels through the first portion 326 of the first pipe 310, through the cross-over pipe 314, and through the first portion 328 of the second pipe 312 may be less than 5 km, for example. As indicated above, the steam may be directed along the first portion 326 of the first pipe 310, through the cross-over pipe 314, and through the first portion 328 of the second pipe 312 for a predetermined period of time for preheating, or until the pipe reaches a target temperature. After the first portion 326 of the first pipe 310 and the first portion 328 of the second pipe 312 are heated, the process continues at 504.

The valve arrangements are adjusted at 504, as described above with reference to FIG. 5, by switching valves to direct steam from the first portion 326 of the first pipe 310 and into the second portion 330 of the first pipe 310, through the second cross-over pipe 316, and back along the second portion 332 of the second pipe 312 and the first portion 328 of the second pipe 312. Utilizing the valve arrangements, including the bypass valves, steam is directed into the second portion 330 of the first pipe 310, through the second cross-over pipe 316, and back along the second portion 332 of the second pipe 312 at low flow rate initially. Referring to the valve arrangement illustrated in FIG. 4, the first cross-over valve 404, the second cross-over valve 406, the further first pipe valves 408, and the further second pipe valves 414 are switched to close the first cross-over valve 404 and the second cross-over valve 406 and to open the further first pipe valves 408 and the further second pipe valves 414 to increase the flow rate of steam.

The valves of the valve arrangement associated with the second cross-over pipe 316 are configured to direct steam from the second portion 330 of the first pipe 310, through the second cross-over pipe 316, and back along the second portion 332 of the second pipe 312. Thus the valves directing the flow of steam from the first pipe 310, through the second cross-over pipe 316 and back along the second pipe 312 are open and the valves controlling flow of the steam into a third portion 334 of the first pipe 310 and into a third portion 336 of the second pipe 312 are closed.

Figure 7:
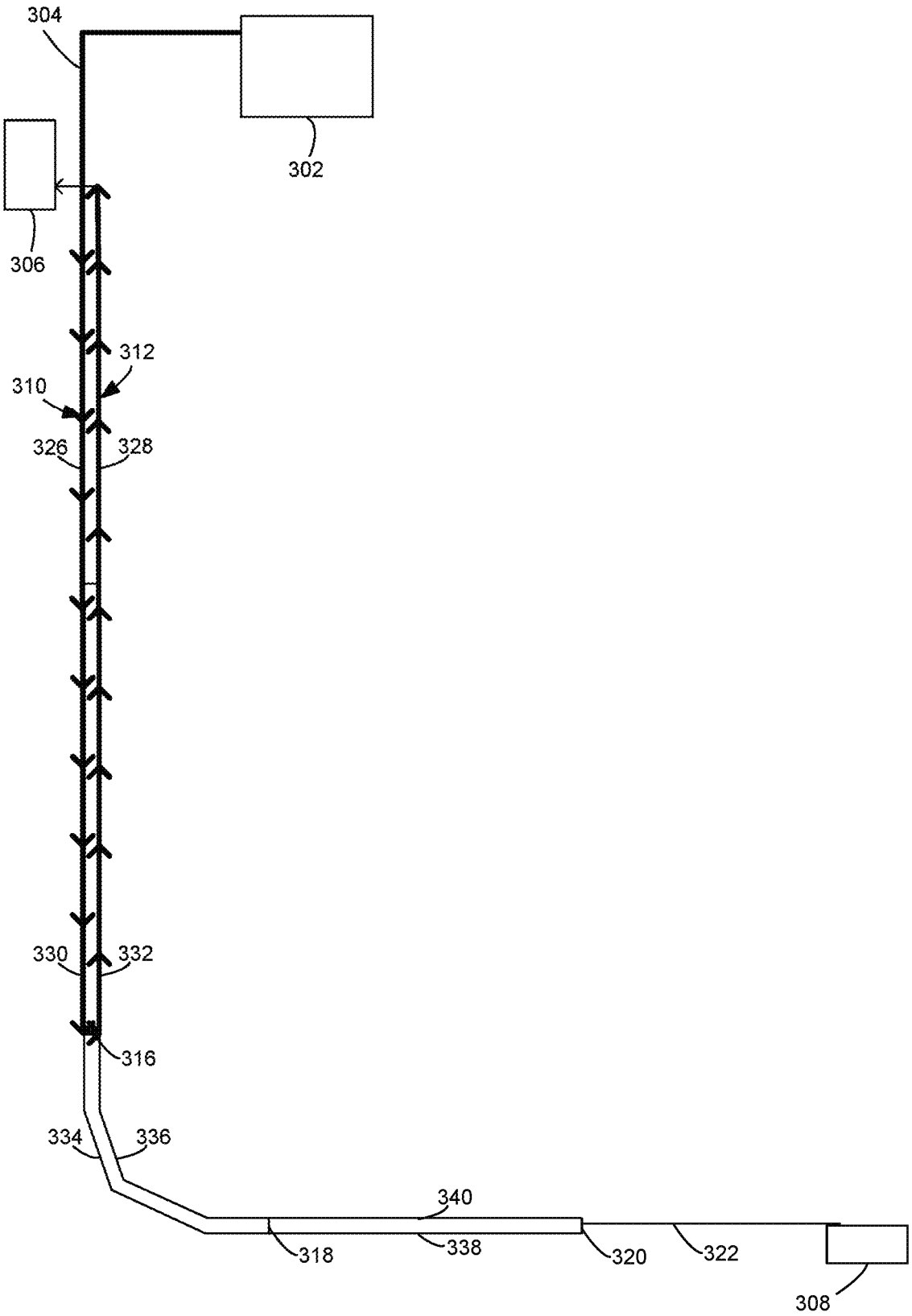

As shown by the arrows in FIG. 7, steam is directed along the first portion of the first pipe 310, along the second portion 330 of the first pipe 310, through the second cross-over pipe 316, through the second portion 332 of the second pipe 312 and through the first portion of the second pipe 312 to heat the second portion 330 of the first pipe 310 and the second portion 332 of the second pipe 312 at 506. After the second portion is heated at 506, the process continues at 508.

There are further portions of the first pipe 310 and the second pipe 312 and the valves are adjusted at 504 to direct steam into the next portion of the first pipe 310 and back along the next portion of the second pipe 312. In particular, the valves associated with the second cross-over pipe 316 and with the third cross-over pipe 318 are adjusted to direct steam into the third portion 334 of the first pipe 310, across the third cross-over pipe 318, and back along the third portion 336 of the second pipe 312. Valves controlling the flow of steam across the second cross-over pipe 316 and valves controlling the flow of steam into a fourth portion 338 of the first pipe 310 and a fourth portion 340 of the second pipe 312 are closed to inhibit the flow of steam across the second cross-over pipe 316 and to inhibit the flow of steam into the fourth portion 338 of the first pipe 310 and the fourth portion 340 of the second pipe 312.

Figure 8:
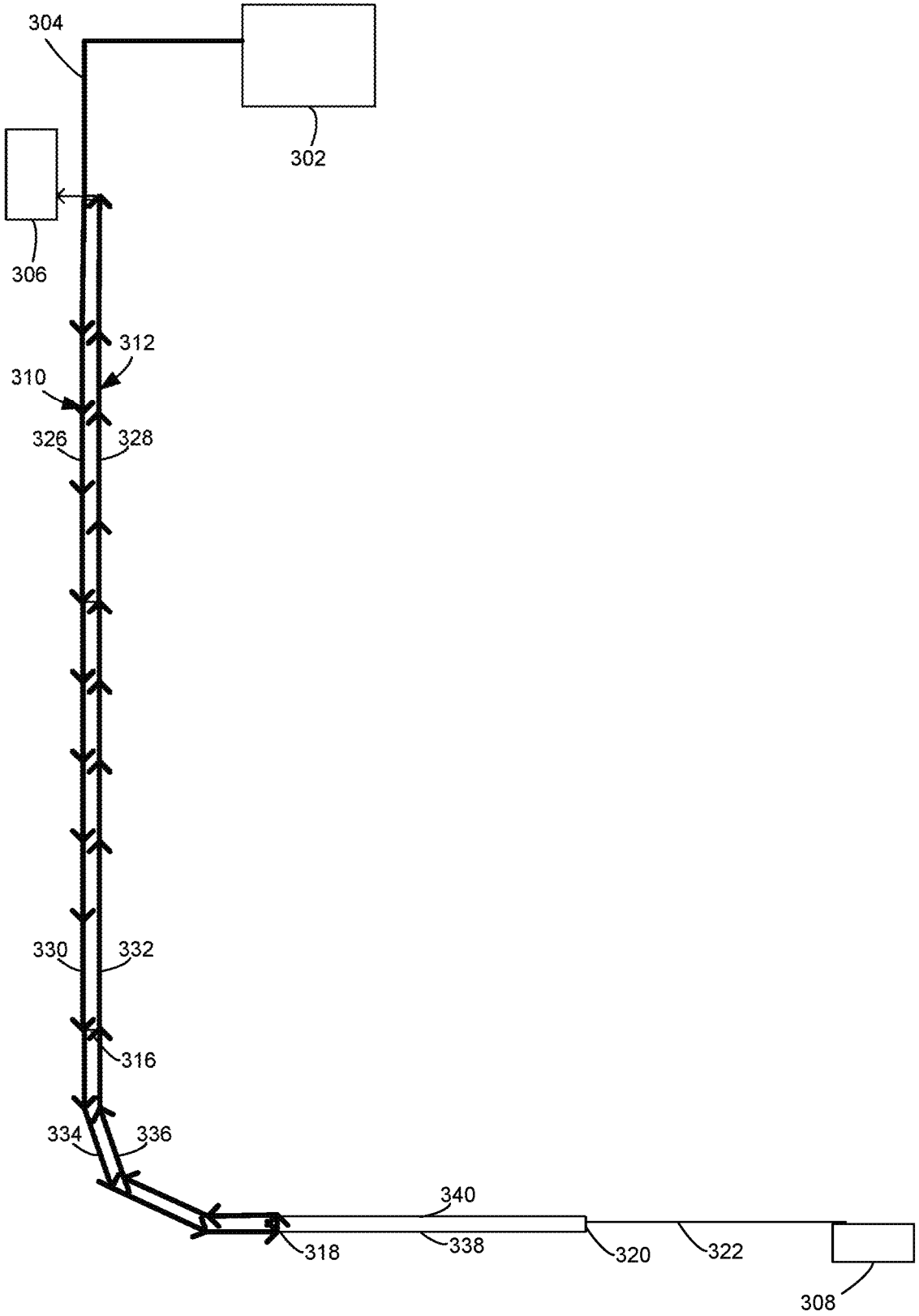

As shown by the arrows in FIG. 8, steam is directed along the first portion 326 of the first pipe 310, the second portion 330 of the first pipe 310, and the third portion 334 of the first pipe 310, across the third cross-over pipe 318, and back along the third portion 336 of the second pipe 312, the second portion 332 of the second pipe 312, and the first portion 328 of the second pipe 312 to heat the third portion 334 of the first pipe 310 and the third portion 336 of the second pipe 312.

There are further portions of the first pipe 310 and the second pipe 312 and valves are adjusted at 504 to direct steam into the next portion of the first pipe 310 and back along the next portion of the second pipe 312. In particular, the valves associated with the third cross-over pipe 318 and with the final cross-over pipe 320 are adjusted to direct steam into the fourth portion 338 of the first pipe 310, across the final cross-over pipe 320, and back along the fourth portion 340 of the second pipe 312. Valves controlling the flow of steam across the third cross-over pipe 318 and valves controlling the flow of steam into the third pipe 322 are closed to inhibit the flow of steam across the third cross-over pipe 318 and to inhibit the flow of steam into the third pipe 322.

Figure 9:
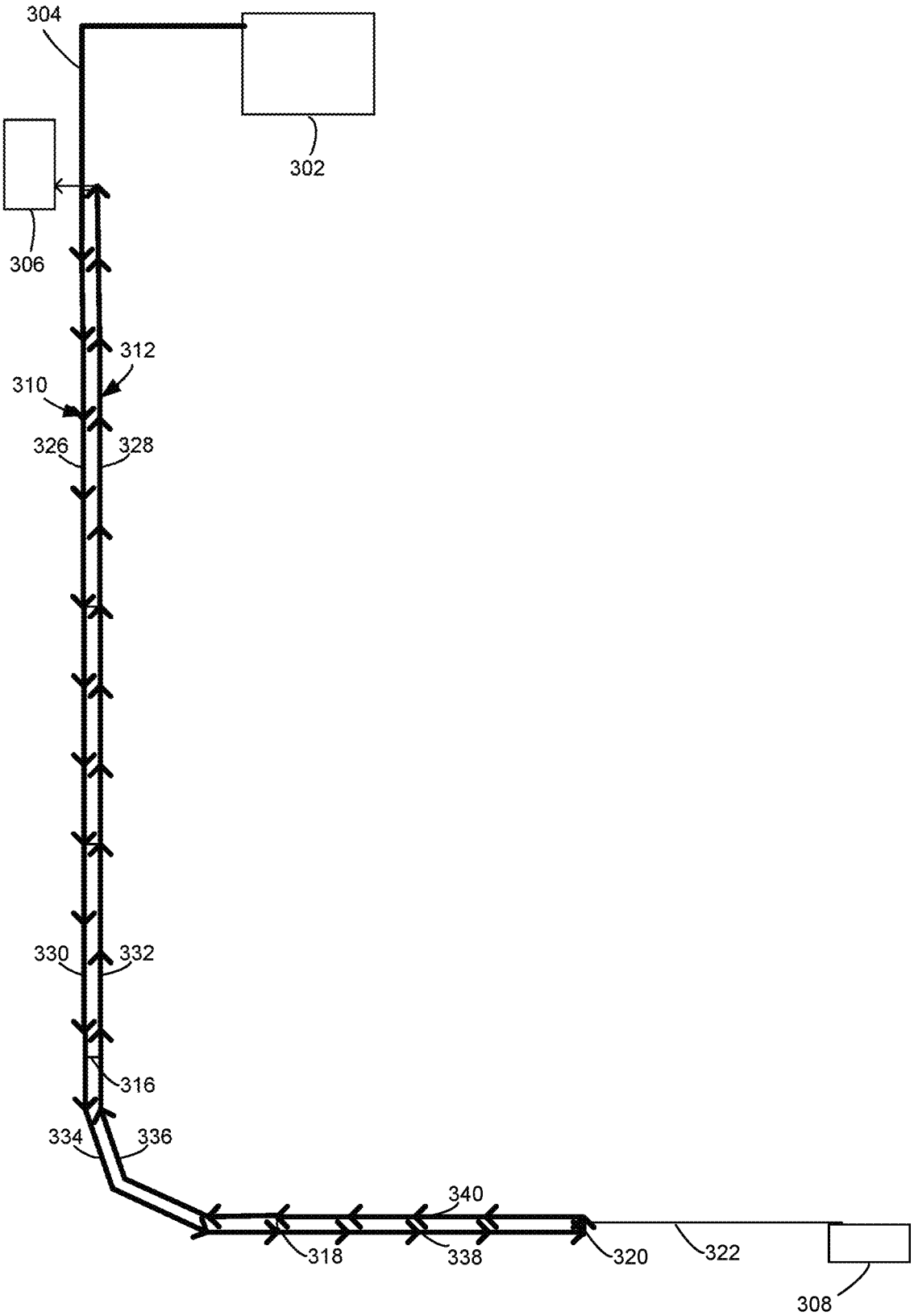

As shown by the arrows in FIG. 9, steam is directed along the first portion 326, the second portion 330, the third portion 334, and the fourth portion 338 of the first pipe 310, across the final cross-over pipe 320, and back along the fourth portion 340, the third portion 336, the second portion 332, and the first portion 328 of the second pipe 312 to heat the fourth portion 338 of the first pipe 310 and the fourth portion 340 of the second pipe 312.

Figure 10:
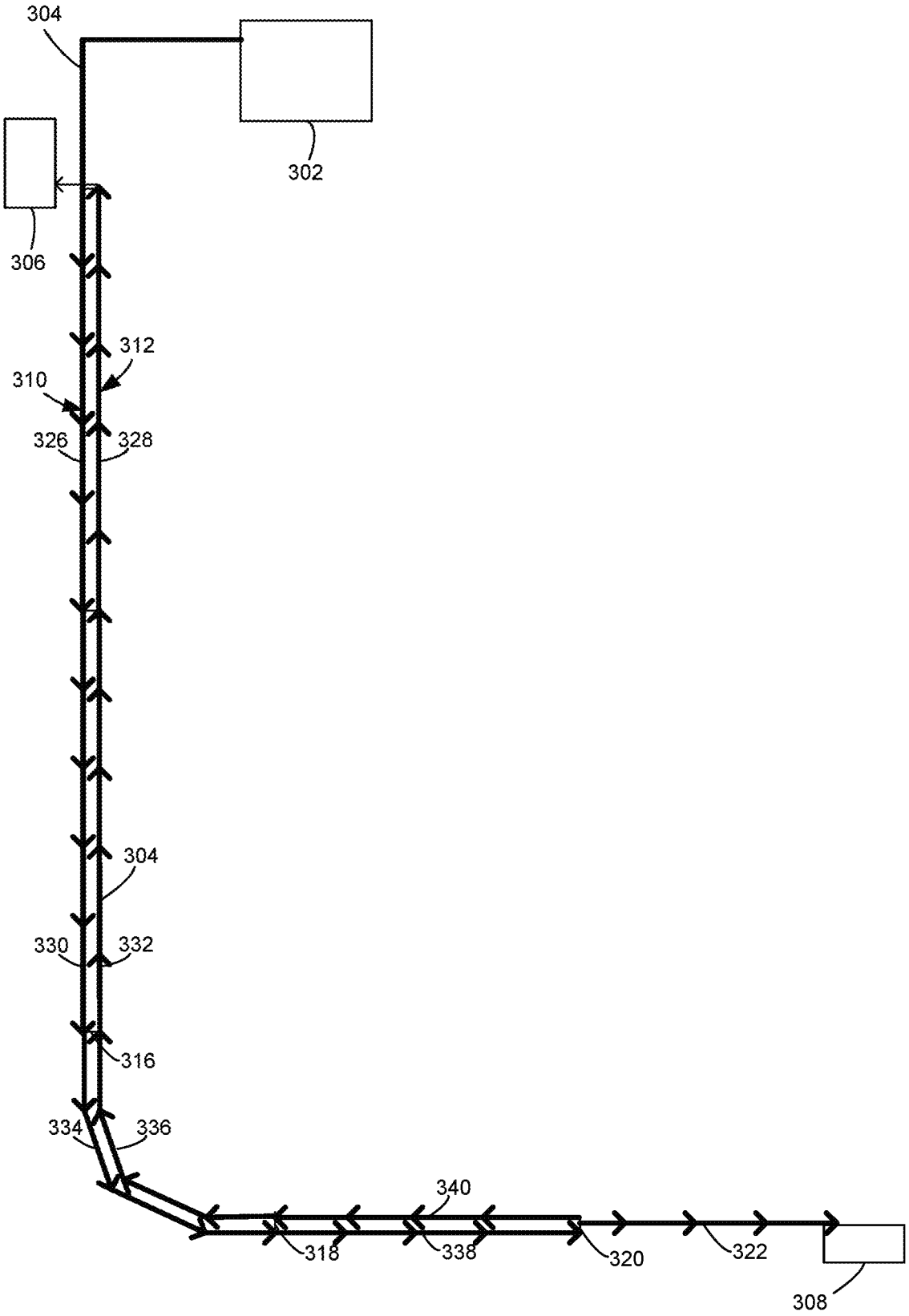

After heating all of the portions of the first pipe 310 and the second pipe 312, as determined at 508, the process continues at 510. The valves of the valve arrangement associated with the final cross-over pipe 320 are adjusted and steam is provided to the injection well on the well pad 308 at 510 by directing steam from the first pipe 310 to the injection well. Thus, the valves of the valve arrangement associated with the final cross-over pipe 320 are adjusted by switching to facilitate steam flow from the end of the first pipe 310 and into the third pipe 322. During a start-up phase, during which a low volume of steam is injected by the injection well on the well pad 308, steam at a high flow rate may be directed along the first pipe 310 and back along the second pipe 312 while the low volume of steam for start-up is directed along the third pipe 322, as illustrated in FIG. 10. The first pipe 310 and the second pipe 312 may be utilized to transport steam to the injection well at a rate that is lower than the rate for a single larger pipe, for example at least 50,000 barrels per day (0.09201 $m^3/s$).

After start-up and during the production phase, a higher volume of steam is utilized to facilitate production of hydrocarbons. Steam may then be directed along the first pipe 310 into the third pipe 322 and steam may also be directed along the second pipe 312 and into the third pipe 322.

Thus, the third pipe 322 is not preheated prior to providing steam to the injection well associated with the well pad 308. The third pipe 322, however, is short by comparison to the length of the entire path from the steam source, which in this example, is the steam line 304 at the well pad 306, to the well pad 308. For example, the third pipe 322 may extend a distance of about 5 km or less, while the entire distance of the path from the steam source to the well pad 306 may exceed 10 km.

The first pipe 310 and the second pipe 312 include drains for draining condensate and tanks for holding the drained water, which may be returned to the steam source, for example, by trucking back. Optionally, each portion of the first pipe 310 and each portion of the second pipe 312 may include drains and may include holding tanks. In addition or alternatively, drains may be included along the first pipe 310 and along the second pipe 312, at low points along the path extending from the steam source to the well pad 308. The third pipe 322 may also include one or more drains to drain condensate therefrom. Each time a new loop is added to heat the next portion of the first pipe 310 and the next portion of the second pipe 312, the new distance travelled may be, for example, 5 km or less.

As indicated above, other well pads including steam injection wells may also be coupled to the steam generation facilities 302 and the wells as the other well pads may be at different stages of production. The steam provided to the well pad 308 may be provided while the volume of steam to another injection well is reduced or even discontinued. Thus, the volume of steam generated at the steam generation facilities may be constant while some of the steam that is generated is diverted to a different well pad.

Figure 11:
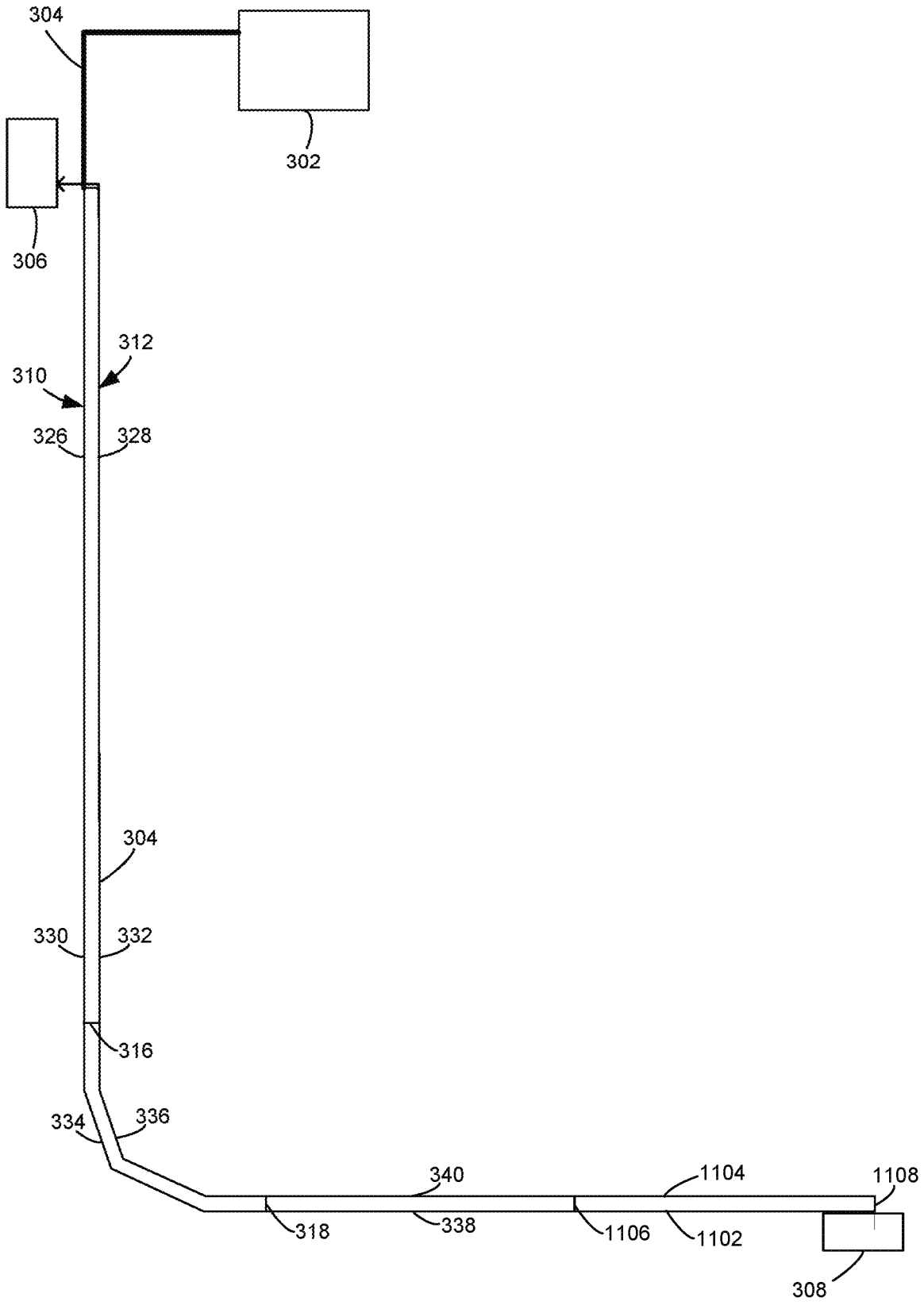
FIG. 11 is a simplified schematic view illustrating another system for use in providing steam in a hydrocarbon recovery operation in accordance with the present disclosure.

Referring to FIG. 11, another example of a system for use in providing steam in a hydrocarbon recovery operation is illustrated. The example shown in FIG. 11 includes many similar elements to the example shown and described with reference to FIG. 3, FIG. 4, and FIG. 6 through FIG. 10. In the example of FIG. 11, however, the first pipe 310 and the second pipe 312 are not fluidly connected to a third pipe. Instead, the first pipe 310 includes a fifth portion 1102 and the second pipe 312 includes a fifth portion 1104.

Rather than a final cross-over pipe 320, a fourth cross-over pipe 1106 couples the first pipe 310 to the second pipe 312, at the end of the fourth portion of the first pipe 338 and the end of the fourth portion 340 of the second pipe. A final cross-over pipe 1108 may be located at the end of the first pipe 310 and the end of the second pipe 312. The fourth cross-over pipe 1106 includes an associated valve arrangement, similar to that shown and described with reference to FIG. 4 to facilitate directing steam from the fourth portion 338 of the first pipe 310, across the fourth cross-over pipe 1106, and back along the fourth portion 340 of the second pipe 312. The associated valve arrangement is adjustable by switching valves to direct steam from the fourth portion 338 of the first pipe 310 into the fifth portion 1102 of the first pipe 310 and to direct steam from the fourth portion 340 of the second pipe 312 and into the fifth portion 1104 of the second pipe. The fifth portion 1102 of the first pipe 310 and the fifth portion 1104 of the second pipe 312 may be heated in a similar manner to that described above for heating the portions of the pipes shown in FIG. 3 and FIG. 6 through FIG. 10.

The first pipe 310 and the second pipe 312 are fluidly coupled to the injection well at the well pad 308, for example, by a line extending from the final cross-over pipe 1108.

The first pipe 310 and the second pipe 312 are utilized to carry the steam along the path from the steam source to the well pad 308. Utilizing, for example, a first pipe of 30 inches (762 mm) diameter and the second pipe of 24 inches (609.6 mm) diameter, a total flow in the two pipes may be equal to the total flow in a single 36 inch (914.4 mm) pipe, while facilitating higher velocity of steam in each of the first pipe 310 and the second pipe 312 than the velocity of steam if a single larger pipe was utilized.

As indicated above, ambient temperatures outside a steam pipe are significantly lower than inside the steam pipe when the steam pipe is utilized to direct steam to the injection well and into the reservoir. Each of the first pipe 310 and the second pipe 312 are insulated to reduce heat loss. Optionally, heat traces may be utilized along a portion or along the entire length of the first pipe 310 and the second pipe 312. The heat traces may be, for example an MIQ™ series heating cable from Thermon™. The heat traces are suitable for high temperature heating well above 300° C. A set of a plurality of heat traces, for example, from 9 heat traces to 27 heat traces may be utilized along parts of either or both the first pipe 310 and the second pipe 312. The heat traces are generally evenly spaced around the outer diameter of the steam pipe 304 and extend generally along a length of the steam pipe 304.

Controllers and resistance temperature detectors (RTDs) may also be utilized to control the heat traces to heat the pipes to reduce heat loss from the steam and degradation of steam quality. The use of such heat traces may reduce the volume of condensate formed.

Advantageously, steam is provided to an injection well on a well pad that is far from any other well pad or the steam generation facilities. For example, steam may be provided to a well pad that is located remote, i.e., spaced more than 10 kilometers away, from any other well pad or steam generation facilities. By looping steam in shorter loops using two pipelines, the pipes can be heated in portions while reducing total condensation and reducing condensate management including draining, storage, and trucking of condensate. When the steam is provided to the injection well, a similar pressure and total flow rate of steam can be transported using two smaller pipelines, rather than a single, larger pipeline. In addition, when less steam is required at the well pad that is far away, such as during late well life, one of the smaller pipes may be utilized to transport the steam rather than both pipes, reducing the total flow rate while maintaining steam velocity in the pipe utilized.

The described embodiments are to be considered in all respects only as illustrative and not restrictive. The scope of the claims should not be limited by the preferred embodiments set forth in the examples, but should be given the broadest interpretation consistent with the description as a whole. All changes that come within the meaning and range of equivalency of the claims are to be embraced within their scope.

The invention claimed is:

1. A system for providing steam to a well of a hydrocarbon-bearing formation, the system comprising:

a steam source;

a first pipe including a plurality of portions of the first pipe with each of the plurality of portions of the first pipe extending along a respective segment of a path between the steam source and the well;

a second pipe including a plurality of portions of the second pipe with each of the plurality of portions of the second pipe extending along the respective segment of the path between the steam source and the well;

a plurality of cross-over pipes, each of the cross-over pipes coupling a respective one of the portions of the first pipe with a corresponding one of the portions of the second pipe; and valve arrangements associated with each of the cross-over pipes, wherein the valve arrangements are selectively configurable between a preheating configuration and a post-preheating delivery configuration:

wherein in the preheating configuration:

a first of the valve arrangements is operable to direct steam received in a first portion of the first pipe from the steam source through a first of the cross-over pipes into a first portion of the second pipe and thereby back to the steam source; and after receipt of the steam from the first portion of the second pipe at the steam source, at least one subsequent of the valve arrangements in series is then operable to direct the steam received in a subsequent portion of the first pipe from the steam source through a subsequent one of the cross-over pipes into a subsequent portion of the second pipe and thereby back to the steam source, thereby resulting in a preheated first pipe and a preheated second pipe along the respective segment of the path; and wherein in the post-preheating delivery configuration:

each of the valve arrangements is operable to (a) disallow passage of the steam through the plurality of cross-over pipes between the preheated first pipe and the preheated second pipe; and (b) allow passage of the steam from the steam source through each of the preheated first pipe and the preheated second pipe, through the respective plurality of portions thereof, to the well.

2. The system according to claim 1, wherein a diameter of the second pipe is smaller than a diameter of the first pipe.

3. The system according to claim 1, wherein the first pipe comprises a 30 inch (0.762 m) diameter pipe.

4. The system according to claim 3, wherein the second pipe comprises a 24 inch (0.6096 m) diameter pipe.

5. The system according to claim 1, wherein the path between the steam source and the well extends a total distance greater than 10 kilometers.

6. The system according to claim 5, wherein ends of the first pipe and the second pipe are coupled to a third pipe that extends along a final segment of the path to the well.

7. The system according to claim 1, wherein the steam source comprises steam piping for supplying steam to a prior well.

8. The system according to claim 1, further comprising at least one drain for draining condensate from the first pipe and at least one drain for draining condensate from the second pipe.

* * * * *